US010666021B2

(12) United States Patent
Niessner et al.

(10) Patent No.: US 10,666,021 B2
(45) Date of Patent: May 26, 2020

(54) SPARK PLUG ELECTRODE ASSEMBLY AND METHOD OF MANUFACTURING SAME

(71) Applicant: Federal-Mogul Ignition GmbH, Neuhaus-Schierschnitz (DE)

(72) Inventors: Werner Niessner, Steinheim (DE); Rene Trebbels, Erkelenz (DE); Andreas Zeh, Sonneberg (DE)

(73) Assignee: FEDERAL-MOGUL IGNITION GMBH, Neuhaus-Schierschni (DE)

( * ) Notice: Subject to any disclaimer, the term of this patent is extended or adjusted under 35 U.S.C. 154(b) by 0 days.

(21) Appl. No.: 16/246,845

(22) Filed: Jan. 14, 2019

(65) Prior Publication Data

US 2019/0229501 A1 Jul. 25, 2019

(30) Foreign Application Priority Data

Jan. 24, 2018 (DE) ..... 10 2018 101 512

(51) Int. Cl.

| | |
|---|---|
| ***H01T 13/20*** | (2006.01) |
| ***H01T 13/32*** | (2006.01) |
| ***H01T 21/02*** | (2006.01) |
| ***H01T 13/39*** | (2006.01) |

(52) U.S. Cl.
CPC ..... *H01T 13/32* (2013.01); *H01T 13/20* (2013.01); *H01T 13/39* (2013.01); *H01T 21/02* (2013.01)

(58) Field of Classification Search
CPC ..... H01T 21/02; H01T 13/20; H01T 13/32; H01T 13/39
USPC ..... 313/141
See application file for complete search history.

(56) References Cited

U.S. PATENT DOCUMENTS

| | | | |
|---|---|---|---|
| 3,901,717 | A | 8/1975 | Revaz |
| 5,347,193 | A | 9/1994 | Oshima et al. |
| 6,064,144 | A | 5/2000 | Knoll et al. |
| 7,049,733 | B2 | 5/2006 | Lykowski et al. |
| 7,279,827 | B2 | 10/2007 | Nunome et al. |
| 8,344,604 | B2 | 1/2013 | Torii et al. |
| 8,766,519 | B2 | 7/2014 | Ma |
| 9,464,618 | B2 | 10/2016 | Stifel et al. |
| 9,698,576 | B2 | 7/2017 | Niessner et al. |
| 9,800,023 | B2 | 10/2017 | Niessner et al. |

(Continued)

FOREIGN PATENT DOCUMENTS

| | | | |
|---|---|---|---|
| CN | 103790753 | A | 5/2014 |
| DE | 19705372 | A1 | 8/1998 |

(Continued)

OTHER PUBLICATIONS

Office action issued by the German Patent and Trademark Office for application No. DE 10 2018 101 512.7.

(Continued)

*Primary Examiner* — Christopher M Raabe
(74) *Attorney, Agent, or Firm* — Reising Ethington, P.C.

(57) ABSTRACT

A spark plug electrode assembly and method of manufacturing a spark plug assembly having an inner and outer electrode component, one of which or both being formed using metal injection molding (MIM). Forming at least one of the inner or outer electrode components with MIM allows for the creation of a mechanical lock and a metallurgical bond at an interface between the components such that the components may be joined without a weld.

20 Claims, 5 Drawing Sheets

(56) References Cited

U.S. PATENT DOCUMENTS

| | | | | |
|---|---|---|---|---|
| 2004/0173588 | A1 | 9/2004 | Benz | |
| 2011/0198981 | A1 | 8/2011 | Kishimoto | |
| 2011/0198983 | A1 | 8/2011 | Manhardt et al. | |
| 2012/0125279 | A1 | 5/2012 | Hampson et al. | |
| 2014/0184054 | A1 | 7/2014 | Nomura et al. | |
| 2015/0130345 | A1 | 5/2015 | Sakakura et al. | |
| 2017/0085061 | A1* | 3/2017 | Niessner | H01T 13/39 |
| 2018/0369919 | A1* | 12/2018 | Burkhardt | B32B 15/01 |

FOREIGN PATENT DOCUMENTS

| | | | |
|---|---|---|---|
| DE | 102011053530 | A1 | 5/2012 |
| DE | 102015115746 | A1 | 3/2017 |
| DE | 102015121862 | A1 | 6/2017 |
| EP | 0400950 | A1 | 12/1990 |
| EP | 2211432 | A1 | 7/2010 |
| WO | 2014177169 | A1 | 11/2014 |

OTHER PUBLICATIONS

Informal translation of Office action issued by the German Patent and Trademark Office for application No. DE 10 2018 101 512.7.
Office action issued by the National Intellectual Property Administration of The People's Republic Of China for application No. CN 201910057976.5.
Informal translation of Office action issued by the National Intellectual Property Administration of The People's Republic of China for application No. CN 201910057976.5.

* cited by examiner

SPARK PLUG ELECTRODE ASSEMBLY AND METHOD OF MANUFACTURING SAME

FIELD

This invention generally relates to spark plugs, and more particularly, to spark plug electrode assemblies and their associated manufacturing methods.

BACKGROUND

Spark plug electrode assemblies can be subject to harsh conditions in engine combustion chambers, including intense thermal cycling. The thermal stress can cause separation between a sparking component and its corresponding ground or center electrode. Moreover, the oftentimes small size of the electrode assemblies and the sometimes intricate shape of the electrode assemblies can lead to challenges when attaching sparking components to electrodes. Manufacturing a sufficiently strong yet economical electrode assembly is desirable.

SUMMARY

According to one embodiment, there is provided an electrode assembly for a spark plug, comprising an inner electrode component, an outer electrode component at least partially surrounding the inner electrode component and having a metal injection molded (MIM) microstructure, and a weldless joint located at an interface of the inner and outer electrode components, wherein the weldless joint creates both a mechanical lock and a metallurgical bond between the inner and outer electrode components at the interface such that no weld is used at the interface.

According to another embodiment, there is provided an electrode assembly for a spark plug, comprising an inner electrode component made from a precious metal based material and an outer electrode component made from a nickel based material and at least partially surrounding the inner electrode component. The outer electrode component has a metal injection molded (MIM) microstructure with a collapsed pore network, and an interface between the inner and outer electrode components. At the interface, the collapsed pore network of the metal injection molded (MIM) microstructure encapsulates at least some of the precious metal based material.

According to another embodiment, there is provided a method of manufacturing an electrode assembly for a spark plug, comprising the steps of metal injection molding a green outer electrode component, debinding the green outer electrode component to form a brown outer electrode component, at least partially inserting an inner electrode component into the brown outer electrode component, sintering the inner electrode component and the brown outer electrode component together to shrink the brown outer electrode component at least partially around the inner electrode component and form a sintered outer electrode component, and creating a mechanical lock and a metallurgical bond at an interface between the inner electrode component and the sintered outer electrode component.

DRAWINGS

Preferred exemplary embodiments will hereinafter be described in conjunction with the appended drawings, wherein like designations denote like elements, and wherein.

DESCRIPTION

The electrode assemblies described herein include a metal injection molded (MIM) microstructure that imparts particular structural and configurational benefits. For example, the various electrode assemblies may provide effective sparking component retention, cost-conscious uses of precious metals, and mechanical property improvement, to cite a few possibilities. Further, in some embodiments, the electrode assemblies may not need a weldment between a precious metal based sparking component and non-sparking component. Accordingly, problems such as large heat affected zones near weld pools, attachment difficulties in view of different thermal expansion coefficients, as well as others, can be avoided. Additionally, with the MIM microstructure, there may be no need for secondary operations such as grinding.

The electrode assemblies described herein can be used in spark plugs and other ignition devices including industrial plugs, aviation igniters, or any other device that is used to ignite an air/fuel mixture in an engine. This includes spark plugs used in automotive internal combustion engines, and particularly in engines equipped to provide gasoline direct injection (GDI), engines operating under lean burning strategies, engines operating under fuel efficient strategies, engines operating under reduced emission strategies, or a combination of these. As used herein, the terms axial, radial, and circumferential describe directions with respect to the generally cylindrical shape of the spark plug of FIG. 1 and generally refer to a center or longitudinal axis $A_L$, unless otherwise specified. Further, the example electrode assemblies shown in the figures are merely illustrative and demonstrative in nature. Actual electrode assemblies may look different than shown.

Figure 1:
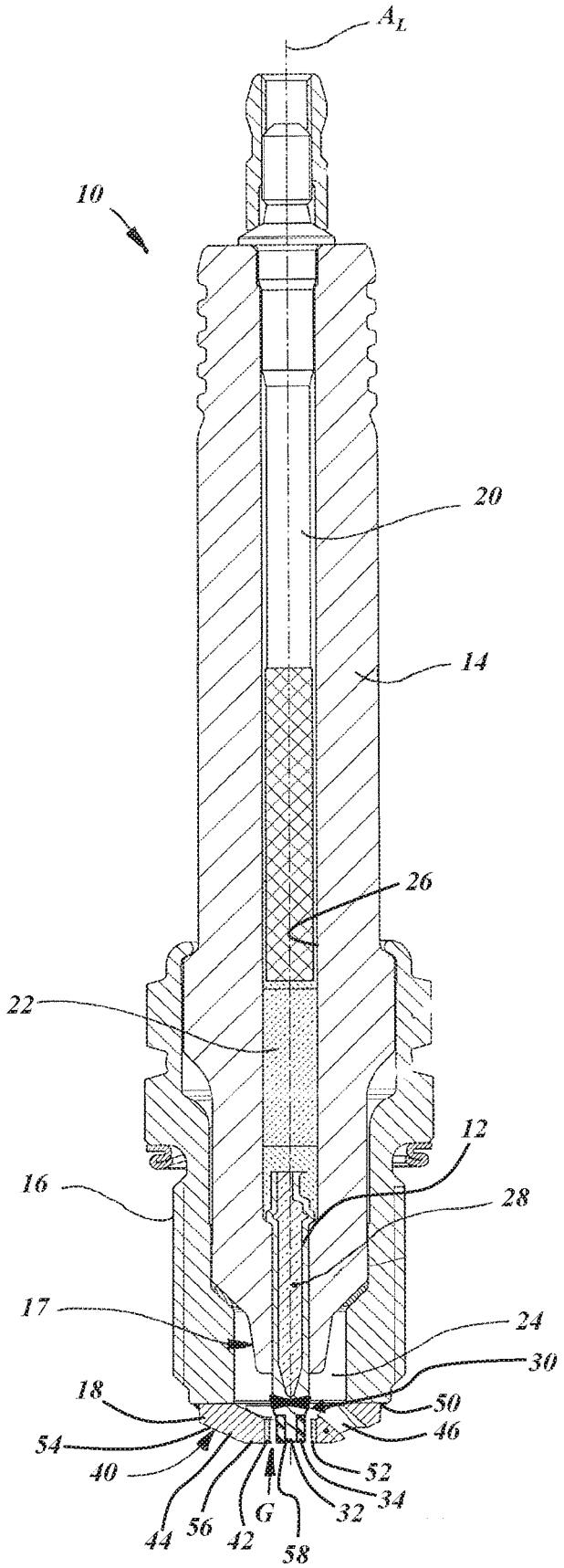
FIG. 1 is cross-sectional view of a spark plug according to one embodiment.

Referring to FIG. 1, a spark plug 10 includes a center electrode base or body 12, an insulator 14, a metallic shell 16, and a ground electrode base or body 18. Other components can include a terminal stud 20, an internal resistor 22, various gaskets, and internal seals, all of which are known to those skilled in the art. The insulator 14 is generally disposed within an axial bore 24 of the metallic shell 16, and has an end nose portion 17 exposed outside of the shell at the firing end of the spark plug 10. The insulator 14 is made of a material, such as a ceramic material, that electrically insulates the center electrode body 12 from the metallic shell 16. The metallic shell 16 provides an outer structure of the spark plug 10, and has threads for installation in the associated engine.

The center electrode body 12 is generally disposed within an axial bore 26 of the insulator 14, and has an end portion exposed outside of the insulator at a firing end of the spark plug 10. In one example, the center electrode body 12 is made of a nickel based (Ni) alloy material that serves as an external or cladding portion of the body, and includes a copper (Cu) or Cu alloy material that serves as an internal core 28 of the body; other materials and configurations are possible including a non-cored body of a single material. As will be detailed further below, the center electrode body 12 may include a center electrode assembly 30, which can be a separate component welded to the center electrode body 12, or may be an integral part of center electrode body 12, depending on the desired implementation. The center electrode assembly 30 includes an inner center electrode component 32 which serves as a non-sparking component, and an outer center electrode component 34 which serves as a sparking component. As detailed below, it is also possible to have the inner electrode component be a non-sparking component and the outer electrode component to be a sparking component.

The ground electrode body 18 is attached to a free end of the metallic shell 16 and, as a finished product, may have an annular shape as depicted or another shape. At an end portion nearest a spark gap G, the ground electrode body 18 is radially spaced from the center electrode body 12 and from the center electrode assembly 30 (if one is provided). Like the center electrode body, the ground electrode body 18 may be made of a Ni alloy material that serves as an external or cladding portion of the body, and can include a Cu or Cu alloy material that serves as an internal core of the body; other examples are possible including non-cored bodies of a single material. Some non-limiting examples of Ni alloy materials that may be used with the center electrode body 12, ground electrode body 18, or both, include Ni—Cr alloys such as Inconel® 600 or 601. The ground electrode body 18 in this embodiment includes a ground electrode assembly 40 having an inner ground electrode component 42 and an outer ground electrode component 44. The center electrode body 12 and the ground electrode body 18, as well as the electrode assemblies 30, 40 can be provided in a number of various shapes and configurations.

The electrode assembly can be a center electrode assembly 30 or a ground electrode assembly 40, wherein either the inner or outer electrode component is the main center electrode body 12 or the main ground electrode body 18, and the other of the inner and outer electrode components is the sparking component. For example, as shown in FIG. 1, the ground electrode assembly 40 is an embodiment in which the outer ground electrode component 44 is the main ground electrode body 18 and the inner electrode component 42 is the sparking component adjacent the spark gap G. Alternatively, the electrode assembly can have an inner or outer electrode component that is welded to the main center electrode body 12 or the main ground electrode body 18. For example, as shown in FIG. 1, the center electrode assembly 30 is an embodiment in which the inner electrode component 32 is welded to the main center electrode body 12 and the outer electrode component 34 is the sparking component adjacent the spark gap G. Other embodiments are certainly possible, such as where the outer electrode component is welded to electrode body, to cite one example. Further, it is possible to have a spark plug with only one electrode assembly. The sparking component is preferably a precious metal based material, such as platinum, iridium, rhodium, or one or more alloys thereof. The non-sparking component is preferably a non-precious metal based material such as a nickel alloy (e.g., Inconel® 600 or 601).

Figure 2:
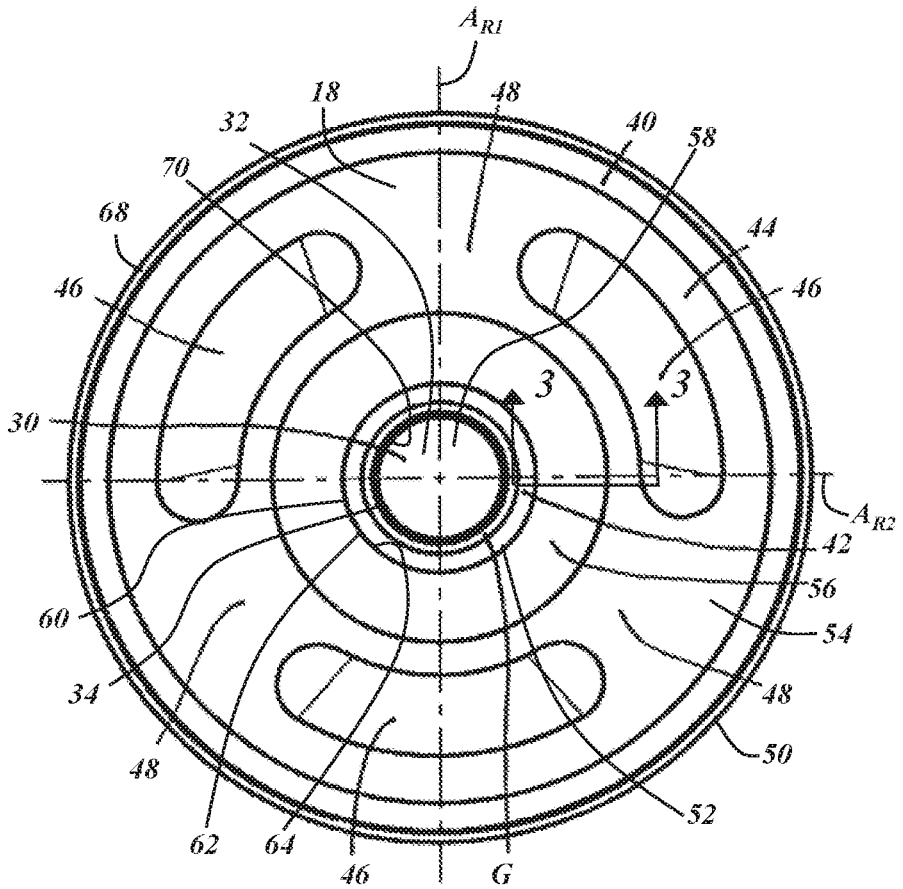
FIG. 2 shows an electrode assembly of the spark plug of claim 1.

FIG. 2 shows an end view of the center electrode assembly 30 and the ground electrode assembly 40 of FIG. 1. As described above, in this embodiment, the outer ground electrode component 44 constitutes the main ground electrode body 18. In this particular implementation, the ground electrode body 18, and correspondingly, the outer ground electrode component 44, includes a number of through holes 46 which generally define legs 48 extending therebetween from an outer circumference 50 to an inner circumference 52. The outer ground electrode component 44 further includes a ramped portion 54 that angles axially from a free end of the metallic shell 16 down toward a planar portion 56 which is generally in line with an axial end surface 58 of the center electrode assembly 30. The planar portion 56 includes an interior side surface 60 which meets at an interface 62 with an exterior side surface 64 of the inner ground electrode component 42. The interior side surface 60 in this embodiment comprises a cylindrical wall which can help provide more structural rigidity, as there is more bonding area of the interior side surface 60 at the interface 62 than in other implementations where the legs 48 extend all the way to the inner circumference 52. In this embodiment, the outer ground electrode component 44 also includes an exterior side surface 68, and the inner ground electrode component 42 includes an interior side surface 70 which is an annular sparking surface that faces the spark gap G.

In the embodiment illustrated in FIGS. 1 and 2, the outer ground electrode component 44 and the inner center electrode component 32 each include an MIM microstructure, which will be detailed further below. The MIM microstructure can impart structural benefits to the electrode assemblies 30, 40, and can avoid some problems that may occur in conventional plugs where a precious metal sparking component is welded to a typically nickel based non-sparking component. Oftentimes, precious metal sparking components are cut from drawn or extruded wires or similarly processed structures. Similarly, non-sparking components, such as a standard ground electrode for a J-gap plug, may be cut from drawn or extruded wires. With drawn or extruded wires, the mechanical properties in the direction of drawing are often quite different than the same properties in the transverse direction. With the MIM microstructure, on the other hand, the mechanical properties can be more uniform in all directions. Accordingly, with reference to FIG. 2, there is shown two transverse axes: a first radial axis $A_{R1}$ and a second radial axis $A_{R2}$, each of which also being transverse to the longitudinal axis $A_L$. The mechanical properties along each set of transverse axes may be the same (i.e., "the same" is within a ~±5% difference). In one embodiment, when Inconel® 601 is used as the electrode component having an MIM microstructure, the breaking strain may be equal to or greater than 30% along each axis. Additionally, with Inconel® 601, the density of the MIM microstructure may be greater than or equal to about 7.6 g/cm$^3$, the yield point may be greater than or equal to about 210 MPa ($R_{p0.2}$) along each axis, the tensile strength may be greater than or equal to about 620 MPa ($R_m$) along each axis, and the hardness may be between about 135-160HV10.

Figure 3A:
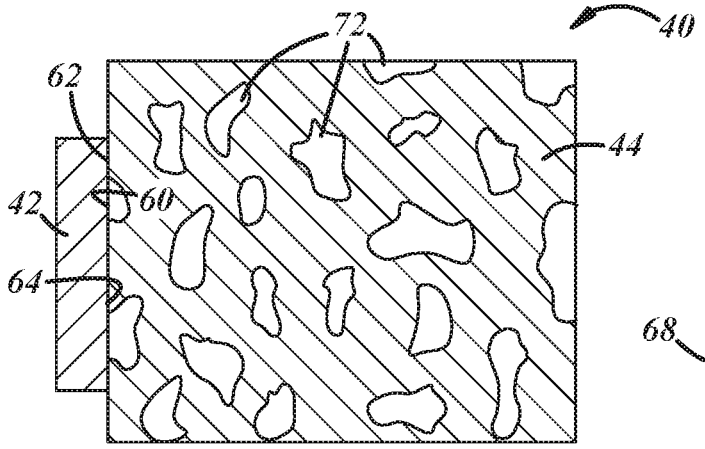
FIGS. 3A and 3B are cross-sectional views which generally correspond with line 3-3 in FIG. 2, showing schematic representations of a semi-formed electrode assembly metallurgical structure in accordance with two embodiments.
Figure 3B:
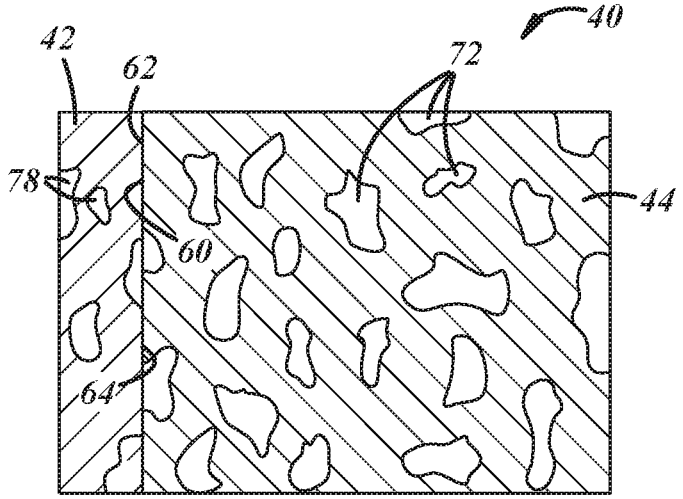
Figure 4:
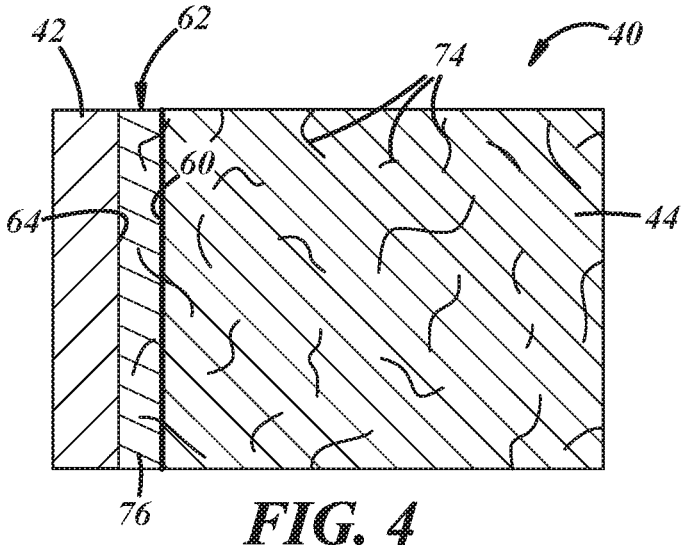
FIG. 4 is a cross-sectional view taken along line 3-3 in FIG. 2 showing a formed electrode assembly.

FIGS. 3A, 3B, and 4 show the MIM microstructure of the ground electrode assembly 40. FIGS. 3A, 3B, and 4 are schematic representations and are not to scale. The various features described with relation to these figures will be apparent to a skilled artisan upon a metallurgical inspection. Further, it should be understood that while these MIM microstructure embodiments are discussed with relation to the ground electrode assembly 40, they are also applicable to the center electrode assembly 30 and other embodiments where either the non-sparking component, the sparking component, or both the non-sparking and sparking components include an MIM microstructure. FIGS. 3A and 3B represent the electrode assembly at an intermediate stage of manufacture, whereas FIG. 4 represents the finished electrode assembly. To produce an MIM microstructure, as detailed further below, a metal powder is mixed with a binder to form a feedstock which is melted an injected into a mold, forming a green part. The binder is removed to form a brown part which is then sintered to produce the finished electrode assembly.

FIGS. 3A and 3B represent different embodiments of the electrode assembly 40 as a brown part, where the binder has been removed to form an open pore network 72 in the outer electrode component 44. In the embodiment of FIG. 3A, the outer electrode component 44 has an MIM microstructure, whereas the inner electrode component 42 does not have an MIM microstructure. The sintered finished version is depicted in FIG. 4, where the open pore network 72 becomes a collapsed pore network 74. Because the open pore network 72 consists of a number of pores or pockets where binder material has been driven off, the overall volume of the outer ground electrode component is larger than the overall volume of the finished outer ground electrode component depicted in FIG. 2. The volume difference between the brown outer ground electrode component and the finished outer ground electrode component correlates with the amount of binder used in the feedstock, and may be about 15-30% by volume, and preferably, is about 20% by volume. The MIM microstructure of the outer electrode component may include a nickel based material from about 80 to 99.99 wt % and a binder material from about 20 to 0.01 wt %.

Different from traditional powder metallurgy sintering, the present sintering process to arrive at the structure represented in FIG. 4 may require higher sintering temperatures and/or longer sintering times, as the densification process required to create the collapsed pore network 74 is more substantial. The sintering process parameters will vary depending on the type of materials being used, the part volume, geometry, etc. The collapsed pore network 74 may contain about 2-5% by volume of equally dispersed pores or voids, and the resulting MIM microstructure will be about 95-98% fully densified. Accordingly, the transition from the open pore network 72 to the collapsed pore network 74 may result in a volumetric reduction in pore space of about 15-18% in one embodiment.

The electrode assemblies 30, 40 of the present disclosure can result in improved bonding between sparking and non-sparking electrode components. As shown in FIG. 4, upon sintering of the brown electrode assemblies depicted in either FIG. 3A or FIG. 3B, a mechanical lock and a metallurgical bond can be formed at the interface 62 between the outer electrode component 44 and the inner electrode component 42. This metallurgical bond and mechanical interlock may be present at an intermetallic layer 76 located at the interface 62, which contains constituents from both the inner electrode component 42 and the outer electrode component 44. In some embodiments, this interface 62 may constitute a weldless joint, where the bond strength is sufficient between the inner electrode component 42 and the outer electrode component 44 such that no weld is used at the interface. Accordingly, as described above, welding specific problems may be avoided. The metallurgical bond and mechanical interlock at the weldless joint may be at least partially attributed to the volumetric shrinkage of the open pore network 72 to the collapsed pore network 74, which causes the outer electrode component 44 to shrink around or relative to the inner electrode component 42. During this process, the interior side surface 62 of the outer electrode component 44 exerts a constrictive inward force against the exterior side surface 64 of the inner electrode component 42, which contributes to the mechanical lock. Accordingly, at the interface 62, there may be solid-state diffusion which results in a diffusion bond to metallurgically bond the inner electrode component 42 to the outer electrode component 44. Further, it is possible that the collapsed pore network 74 in the MIM microstructure encapsulates at least some of the material of the inner electrode component 42, which in this embodiment, is a precious metal based material used as a sparking component. Thus, at the interface 62 and/or intermetallic layer 76, the collapsed pore network 74 may be present. Additionally, grain boundaries may not be confined to the interface. For example, in the illustrated embodiment, it is possible for grain boundaries of precious metal particles to extend past the interface 62 into a nickel based material used for the non-sparking component. Alternatively, grain boundaries of nickel particles may extend past the interface 62 into the precious metal based material used for the sparking component.

FIG. 3B represents another embodiment wherein both the inner electrode component 42 and the outer electrode component 44 have an MIM microstructure. Accordingly, in the finished electrode assembly 40, the collapsed pore network 74 will extend through the inner electrode component 42, the intermetallic layer 76, and the outer electrode component 44. In this embodiment, it is preferable if the degree of volumetric shrinkage for the outer electrode component 44 is greater than the degree of volumetric shrinkage for the inner electrode component 42, such that a volumetric shrinkage variance between the components to be bonded allows for a mechanical lock and a metallurgical bond between the components at the interface. The volumetric shrinkage variance can allow for a weldless joint at the interface such that no weld is used at the interface, because the interior side surface 60 of the outer electrode component 44 is able to exert a constrictive inward force against the exterior side surface 64 of the inner electrode component 62. The volumetric shrinkage variance can be adjusted by altering the binder amounts present in the feedstock material used to form the inner and outer electrode components, respectively. To cite one example, the volumetric shrinkage variance may be about 5-20% such that the difference in the relative shrinkage between parts is sufficient to create a weldless joint. In one example, this may be accomplished by including 5-20% or more binder by volume in the outer electrode component. Accordingly, creating a larger open pore network 72 in the outer electrode component 44 than an open pore network 78 in the inner electrode component 42 can help create a more robust metallurgical bond and mechanical lock at the interface 62, as the densification will be more substantial in the outer electrode component 44 than in the inner electrode component 42.

Figure 5:
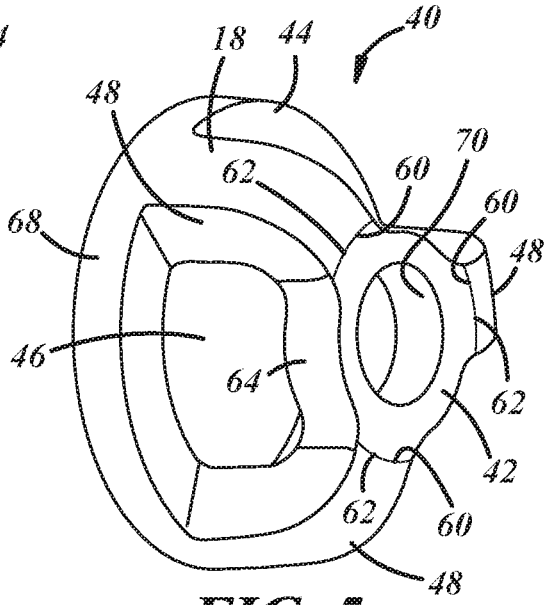
FIGS. 5-7 show ground electrode assemblies according to various embodiments.
Figure 6:
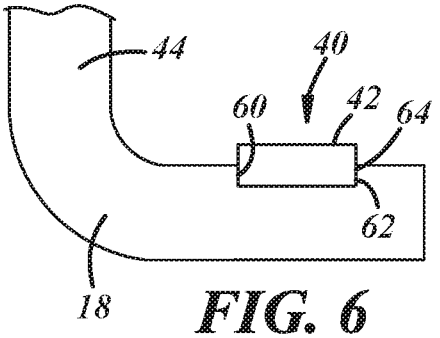
Figure 7:
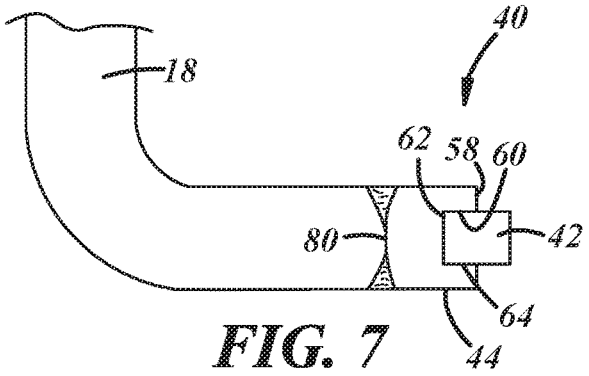
Figure 10:
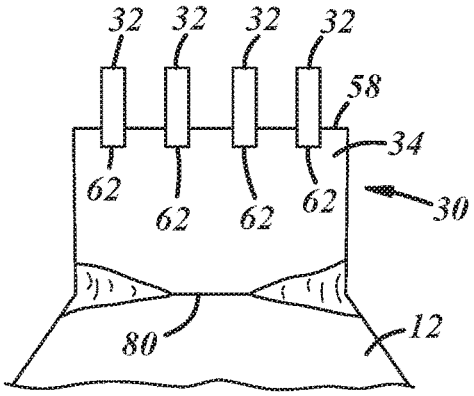
FIGS. 8-12 show center electrode assemblies according to various embodiments.

FIGS. 5-7 show different examples of ground electrode assemblies 40 according to various embodiments. FIG. 5 is similar to the embodiment of FIGS. 1 and 2 in that they both have annular-shaped sparking components, except that there is a non-contiguous inner side surface 60 of the outer ground electrode component 44 that accordingly forms a non-contiguous interface 62 between the inner ground electrode component 42 and the outer ground electrode component 44. Given the complex geometry of this embodiment, it may be beneficial to metal injection mold both the inner ground electrode component 42 and the outer ground electrode component 44. In the embodiment of FIG. 5, similar to the previously described embodiment, the outer ground electrode component 44 is the main ground electrode body 18. FIG. 6 shows a standard J-gap configuration, where the inner ground electrode component 42 may be a standard precious metal sparking component in the form of a columnar or other shaped chip, to cite one example. The outer ground electrode component 44 can have an MIM microstructure, and during manufacture, the inner ground electrode component 42 can be inserted into a blind hole or the like and then sintered with the outer ground electrode component 44 to form the ground electrode assembly 40. FIG. 7 also shows a standard J-gap configuration, but unlike the other illustrated embodiments, the ground electrode assembly 40 is a separate firing tip assembly that is welded to an axial end of the main ground electrode body 18 at an attachment surface 80. Accordingly, the weld joint includes constituents from the outer electrode component and the corresponding electrode, but does not include constituents from the inner electrode component. As mentioned above, it is possible for the outer ground electrode component 44 or both the outer ground electrode component 44 and the inner ground electrode component 42 to have an MIM microstructure. Reference numerals for the various side surfaces are omitted in FIGS. 6 and 7 for clarity purposes.

Figure 8:
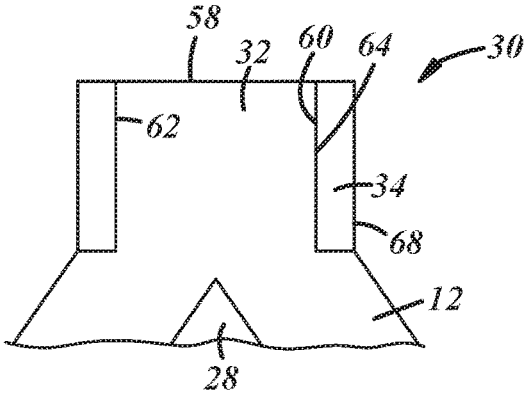
Figure 9:
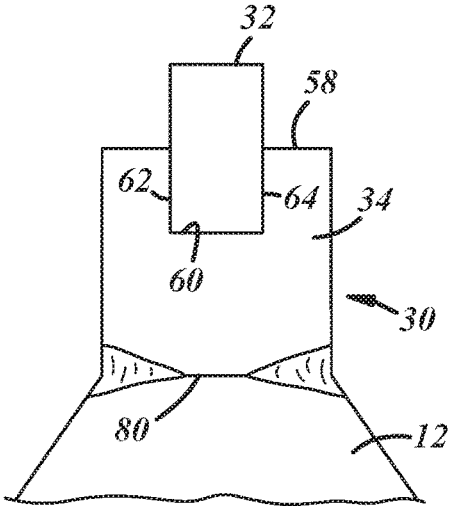

FIGS. 8-12 show different examples of center electrode assemblies 30 according to various embodiments. FIG. 8 is similar to the embodiment of FIGS. 1 and 2, except that the inner center electrode component 32 is the main center electrode body 12. The sparking component in this embodiment is sleeve-shaped. With an inner center electrode component 32 having an MIM microstructure, it is possible to metal injection mold the main center electrode body 12 around a solid copper core 28. Accordingly, an MIM-formed mechanical lock and metallurgical bond may be generated between both the center electrode body 12 and the copper core 28, as well as with an outer center electrode component 34 that also has an MIM microstructure. Further, in the embodiment of FIG. 8, the axial end surface 58 of the center electrode assembly 30 has a generally planar structure, which contrasts with the axial end surfaces 58 in FIGS. 9 and 10. FIG. 9 shows a center electrode assembly 30 having an inner center electrode component 32 which is similar to the ground electrode embodiments of FIGS. 6 and 7, in which the inner center electrode component 32 is a sparking component that is inserted into a blind hole or recess in the outer center electrode component 34, which has an MIM microstructure. Upon co-sintering, a weldless joint can be formed at an interface 62 between an interior side surface 60 of the outer center electrode component 34 and an exterior side surface 64 of the inner center electrode component 32. The FIG. 10 embodiment is similar to the FIG. 9 embodiment, but includes multiple inner center electrode components 32 (which can also be implemented with the ground electrode assembly 40). Accordingly, this embodiment has multiple weldless joints at each interface 62. Reference numerals for the various side surfaces are omitted in FIG. 10 for clarity purposes. The center electrode assemblies 30 in FIGS. 9 and 10 both include an attachment surface 80 for welding to the main center electrode body 12.

Figure 11:
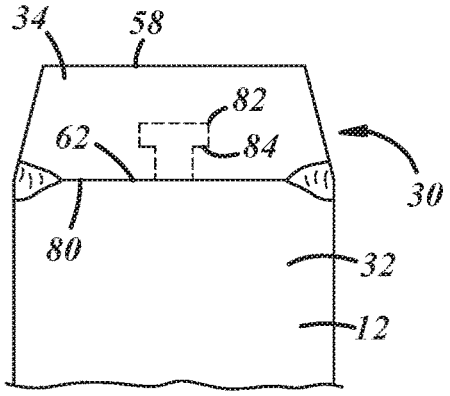

FIG. 11 illustrates an embodiment of a center electrode assembly 30 where the outer center electrode component 34 is the sparking component, and is sintered around an attachment feature 82 located on the inner center electrode component 32. A flange 84 of the attachment feature 82 may be small enough to allow insertion of the inner center electrode component 32 into the outer center electrode component 34, and subsequent shrinkage of the MIM microstructure of the outer center electrode component 34 around the flange 84. The attachment feature 82 and/or flange 84 may be designed so as to help prevent sagging of the MIM microstructure during sintering. Additionally, in the embodiment of FIG. 11, the interface 62 is reinforced with a weld, which is possible with a number of embodiments.

Figure 12:
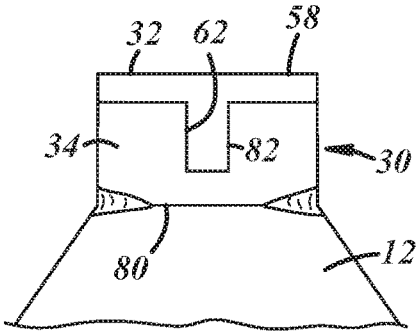

FIG. 12 illustrates an embodiment of a center electrode assembly 30 where the inner center electrode component 32 is provided with an attachment feature 82, and the inner center electrode component 32 is a sparking surface, unlike the embodiment of FIG. 11 where the inner electrode component 32 is a non-sparking surface. With the embodiments of both FIGS. 11 and 12, it is possible to metal injection mold the outer center electrode component 34 with a hole or recess to help accommodate the inner center electrode component 32 before they are sintered together. Reference numerals for the various side surfaces are omitted in FIGS. 11 and 12 for clarity purposes.

Figure 13:
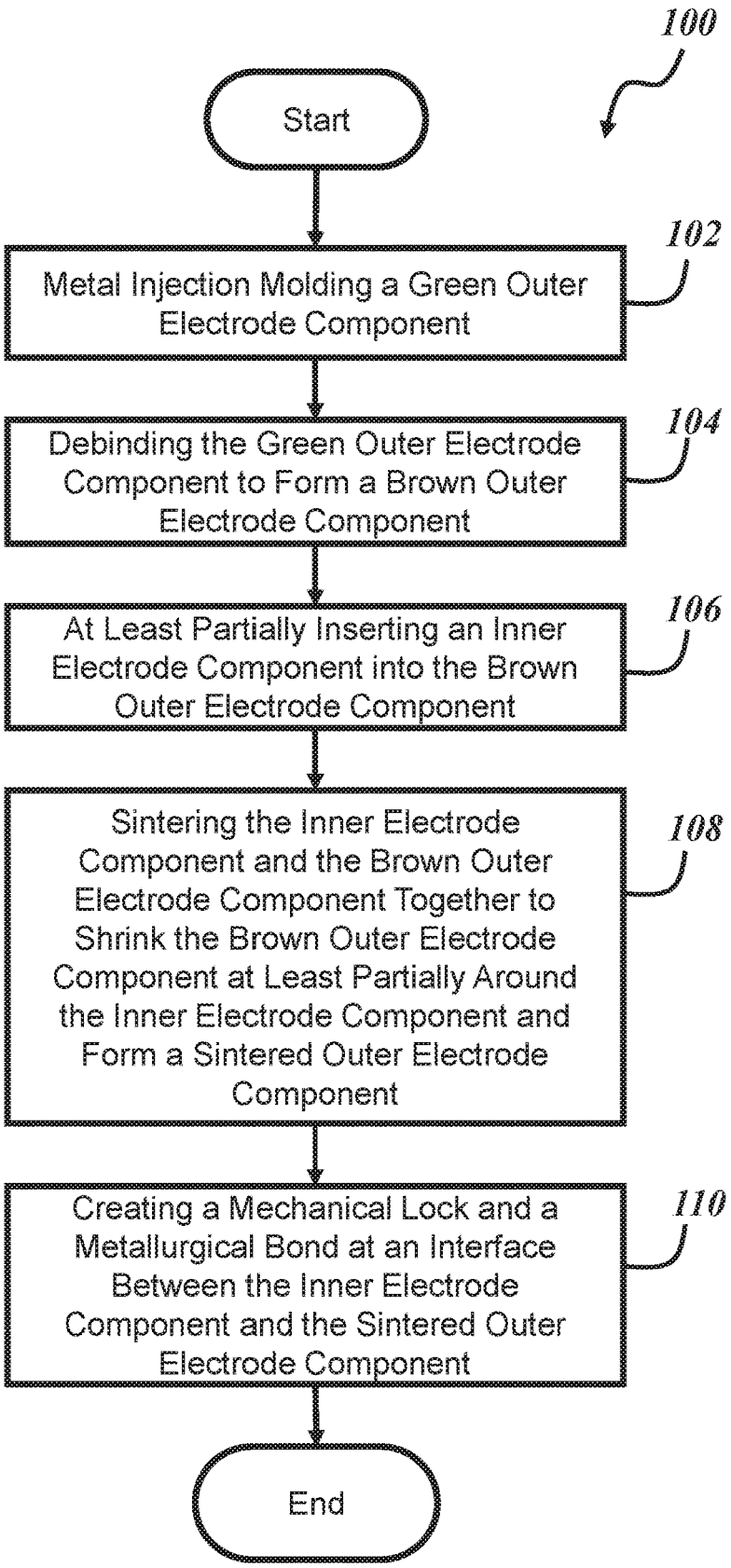
FIG. 13 is a flowchart of an example method that may be used to manufacture an electrode assembly according to one embodiment.

FIG. 13 is a flowchart illustrating example steps that may be used in a method 100 to manufacture an electrode assembly in accordance with the present disclosure. The method 100 is merely one example of a manufacturing method, as the electrode assemblies described herein can be manufactured in accordance with various adaptations as needed or desired.

Step 102 of the method involves metal injection molding a green outer electrode component 34, 44. This step involves mixing a metal powder with a binder (wax, thermoplastic polymer, etc.) that can hold the metal particles in suspension during the injection process. The metal powder and binder mixture may be referred to as a feedstock which is fed into an injection molding machine, melted, and injected into a mold, the shape of which being structurally analogous to the desired shape of the outer electrode component 34, 44 and adjusted accordingly to account for the volumetric difference between the finished parts and the green/brown parts. Micro injection molding machines may need to be used depending on the size of the electrode assemblies. If the outer electrode component will be a sparking component, a precious metal powder may be used, such as platinum, iridium, rhodium, silver, palladium, an alloy thereof, or a combination of various precious metal based powders. If the outer electrode component will be a non-sparking component, a non-precious metal powder may be used, such as a nickel-based alloy, including but not limited to Inconel® 600 or 601. A preferred average particle size of the metal powder is from 2 to 5 microns.

Step 104 of the method involves debinding the green outer electrode component to form a brown outer electrode component 34, 44. This step may be accomplished in one of a number of ways, including via catalytic means, thermal means, or solvent-based means, and may depend on the binder system being used. A small of binder may be left in the brown outer electrode component 34, 44 to act as a backbone to help hold together the brown part.

Step 106 involves at least partially inserting an inner electrode component 32, 42 into the brown outer electrode component 34, 44. As described above, the brown outer electrode component 34, 44 may have a molded hole or recess to help accommodate the inner electrode component 32, 42. Alternatively, this step may be performed when the outer electrode component is in the green stage, followed by debinding the green outer electrode component when the inner electrode component is inserted.

Step 108 involves sintering the inner electrode component 32, 42 and the brown outer electrode component 34, 44 together to shrink the brown outer electrode component at least partially around the inner electrode component. This can create, in step 110, a sintered outer electrode component 34, 44 having a mechanical lock and a metallurgical bond at the interface between the inner and outer electrode components. Depending on the bonding strength, this interface may include a weldless joint where no weld is used to reinforce the connection between the inner and outer electrode components. As described above, in comparison with traditional powder metallurgy sintering, the present sintering process may require higher sintering temperatures and/or longer sintering times, as the densification process required to create the collapsed pore network in the MIM microstructure is more substantial. The sintering process parameters will vary depending on the type of materials being used, the part volume, geometry, etc. In one embodiment, the sintering temperature could be about 80% of the melt temperature of the MIM formed part. It is possible, however, for one of the alloying elements to melt or partially melt during the sintering process. Sintering may be accomplished in a controlled atmosphere or vacuum.

It is to be understood that the foregoing description is not a definition of the invention, but is a description of one or more preferred exemplary embodiments of the invention. The invention is not limited to the particular embodiment(s) disclosed herein, but rather is defined solely by the claims below. Furthermore, the statements contained in the foregoing description relate to particular embodiments and are not to be construed as limitations on the scope of the invention or on the definition of terms used in the claims, except where a term or phrase is expressly defined above. Various other embodiments and various changes and modifications to the disclosed embodiment(s) will become apparent to those skilled in the art. All such other embodiments, changes, and modifications are intended to come within the scope of the appended claims As used in this specification and claims, the terms "for example," "e.g.," "for instance," "such as," and "like," and the verbs "comprising," "having," "including," and their other verb forms, when used in conjunction with a listing of one or more components or other items, are each to be construed as open-ended, meaning that that the listing is not to be considered as excluding other, additional components or items. Other terms are to be construed using their broadest reasonable meaning unless they are used in a context that requires a different interpretation.

The invention claimed is:

1. An electrode assembly for a spark plug, comprising:

an inner electrode component;

an outer electrode component at least partially surrounding the inner electrode component and having a metal injection molded (MIM) microstructure; and a weldless joint located at an interface of the inner and outer electrode components, wherein the weldless joint creates both a mechanical lock and a metallurgical bond between the inner and outer electrode components at the interface such that no weld is used at the interface.

2. The electrode assembly of claim 1, wherein the electrode assembly is a center electrode assembly, the inner electrode component is a sparking component made from a precious metal based material, and the outer electrode component is a non-sparking component made from a nickel based material having the metal injection molded (MIM) microstructure.

3. The electrode assembly of claim 2, wherein the inner electrode component is a columnar shaped sparking component that includes an exterior side surface and an axial end surface, a portion of the exterior side surface is located at the interface and provides constituents to the weldless joint that contribute to the metallurgical bond, and the axial end surface is a sparking surface that faces a spark gap.

4. The electrode assembly of claim 2, wherein the center electrode assembly includes a plurality of inner electrode components, each of the inner electrode components is a columnar shaped sparking component made from a precious metal based material, is at least partially surrounded by the outer electrode component, and includes an axial end surface that is a sparking surface that faces a spark gap.

5. The electrode assembly of claim 2, wherein the outer electrode component is a non-sparking component that includes a blind hole with an interior side surface, the interior side surface is located at the interface and provides constituents to the weldless joint that contribute to the metallurgical bond, and the outer electrode component is metallurgically shrunk around the inner electrode component such that the interior side surface exerts a constrictive inward force against the inner electrode component that contributes to the mechanical lock.

6. The electrode assembly of claim 1, wherein the electrode assembly is a center electrode assembly, the inner electrode component is a non-sparking component made from a nickel based material, and the outer electrode component is a sparking component made from a precious metal-based material having the metal injection molded (MIM) microstructure.

7. The electrode assembly of claim 6, wherein the outer electrode component is a sleeve shaped sparking component that includes an interior side surface and an exterior side surface, the interior side surface is located at the interface and provides constituents to the weldless joint that contribute to the metallurgical bond, the exterior side surface is a sparking surface that faces a spark gap, and the outer electrode component is metallurgically shrunk around the inner electrode component such that the interior side surface exerts a constrictive inward force against the inner electrode component that contributes to the mechanical lock.

8. The electrode assembly of claim 1, wherein the electrode assembly is a ground electrode assembly, the inner electrode component is a sparking component made from a precious metal based material, and the outer electrode component is a non-sparking component made from a nickel based material having the metal injection molded (MIM) microstructure.

9. The electrode assembly of claim 8, wherein the inner electrode component is an annular shaped sparking component that includes an exterior side surface and an interior side surface, the exterior side surface is located at the interface and provides constituents to the weldless joint that contribute to the metallurgical bond, and the interior side surface is an annular sparking surface that faces a spark gap.

10. The electrode assembly of claim 8, wherein the outer electrode component is a non-sparking component that includes an interior side surface, the interior side surface is located at the interface and provides constituents to the weldless joint that contribute to the metallurgical bond, and the outer electrode component is metallurgically shrunk around the inner electrode component such that the interior side surface exerts a constrictive inward force against the inner electrode component that contributes to the mechanical lock.

11. The electrode assembly of claim 1, wherein the electrode assembly is a multi-piece firing tip assembly that is attached to a center electrode or a ground electrode with a weld joint, the weld joint is located at an attachment surface of the outer electrode component and includes constituents from the outer electrode component and the center or ground electrode, but does not include constituents from the inner electrode component.

12. The electrode assembly of claim 1, wherein the weldless joint at the interface of the inner and outer electrode components includes an intermetallic layer and an interlocked layer, the intermetallic layer includes intermetallic compounds formed with constituents from a precious metal based material and a nickel based material that contribute to the metallurgical bond, and the interlocked layer includes pores formed in the metal injection molded (MIM) microstructure of the outer electrode component that are filled in with material from the inner electrode component so as to contribute to the mechanical lock.

13. The electrode assembly of claim 12, wherein grain boundaries of precious metal particles extend past the interface into the nickel based material and grain boundaries of nickel particles extend past the interface into the precious metal based material.

14. The electrode assembly of claim 1, wherein the outer electrode component is made from a nickel based material, the inner electrode component is made from a precious metal based material, and a collapsed pore network in the metal injection molded (MIM) microstructure encapsulates at least some of the precious metal based material.

15. The electrode assembly of claim 1, wherein the outer electrode component or an inner electrode component having a metal injection molded (MIM) microstructure exhibits a breaking strain along a first axis and the same breaking strain along a second axis, wherein the first axis and the second axis are transverse axes.

16. The electrode assembly of claim 1, wherein the metal injection molded (MIM) microstructure of the outer electrode component includes a nickel based material from 80 to 99.99 wt % and a binder material from 20 to 0.01 wt %.

17. A spark plug, comprising:

a metallic shell having an axial bore;

an insulator having an axial bore and being disposed at least partially within the axial bore of the metallic shell;

a ground electrode comprising the electrode assembly of claim 1, wherein the outer electrode component or a ground electrode body is attached to the metallic shell; and a center electrode having a sparking component and being disposed at least partially within the axial bore of the insulator, wherein the inner electrode component creates a spark gap with the sparking component of the center electrode.

18. A spark plug, comprising:

a metallic shell having an axial bore;

an insulator having an axial bore and being disposed at least partially within the axial bore of the metallic shell;

a ground electrode having a sparking component and being attached to the metallic shell; and a center electrode comprising the electrode assembly of claim 1, wherein the inner electrode component creates a spark gap with the sparking component of the ground electrode.

19. An electrode assembly for a spark plug, comprising:

an inner electrode component made from a precious metal based material;

an outer electrode component made from a nickel based material and at least partially surrounding the inner electrode component, wherein the outer electrode component has a metal injection molded (MIM) microstructure with a collapsed pore network; and an interface between the inner and outer electrode components, wherein at the interface, the collapsed pore network of the metal injection molded (MIM) microstructure encapsulates at least some of the precious metal based material.

20. A method of manufacturing an electrode assembly for a spark plug, comprising the steps of:

metal injection molding a green outer electrode component;

debinding the green outer electrode component to form a brown outer electrode component;

at least partially inserting an inner electrode component into the brown outer electrode component;

sintering the inner electrode component and the brown outer electrode component together to shrink the brown outer electrode component at least partially around the inner electrode component and form a sintered outer electrode component; and creating a mechanical lock and a metallurgical bond at an interface between the inner electrode component and the sintered outer electrode component.

* * * * *